United States Patent [19]

Maric et al.

[11] Patent Number: 5,009,271

[45] Date of Patent: Apr. 23, 1991

[54] DRILL ASSEMBLY

[76] Inventors: Milan Maric, Box 1, Site 32, R.R. #4, Calgary, Alberta, Canada, T2M 4H4; John I. Kulas, 2620 Signal Hill Drive S.W., Calgary, Alberta, Canada, T3H 2T7

[21] Appl. No.: 552,921

[22] Filed: Jul. 16, 1990

[51] Int. Cl.[5] ..... E21D 1/00

[52] U.S. Cl. ..... 175/53; 175/385; 175/171; 175/398; 175/260; 175/257

[58] Field of Search ..... 175/385, 53, 55, 91, 175/171, 398, 402, 260, 261, 257; 408/150

[56] References Cited

U.S. PATENT DOCUMENTS

| | | | |
|---|---|---|---|
| 3,416,616 | 12/1968 | Ahlgren | 175/399 |
| 3,648,789 | 3/1972 | Eriksson | 175/292 |
| 3,753,470 | 8/1973 | Lagerstrom et al. | 175/292 |
| 4,408,669 | 10/1983 | Wiredal | 175/171 |
| 4,545,443 | 10/1985 | Wiredal | 175/171 |
| 4,620,600 | 11/1986 | Persson | 175/398 |
| 4,765,416 | 8/1988 | Bjerking et al. | 175/257 |
| 4,770,259 | 9/1988 | Jansson | 175/398 |
| 4,817,741 | 4/1989 | Lof | 175/398 |

*Primary Examiner*—Ramon S. Britts
*Assistant Examiner*—Roger J. Schoeppel
*Attorney, Agent, or Firm*—George H. Dunsmuir

[57] ABSTRACT

Drill tools with eccentric bits for drilling a hole having a large diameter generally include a bit for swinging out to an eccentric position for drilling, and for swinging into a non-eccentric position for removal from a tubular casing. Relatively complicated structures are required for effecting bit movement, and it is often difficult to remove the bit for replacement or repair. A drill assembly offering a solution to both problems includes a mandrel for rotatable mounting in a tubular casing, a bit rotatably mounted in the mandrel, the bit and mandrel normally rotating together in one direction with the bit eccentric with respect to the mandrel, whereby the bit can bore a hole larger in diameter than the casing, a head on the bit for engaging a formation to stop rotation of the bit, shoulders on the bit and mandrel for retaining the bit in the eccentric drilling position, and inclined cam surface on the bit for engaging the bottom of the casing when the bit is moved upwardly to cause the bit to rotate in the other direction (opposite to the drilling direction) to a release position in which the bit is aligned with the casing for movement therethrough, and second shoulders on the mandrel and bit for limiting rotation of the bit to the release position. The shoulders on the mandrel and bit are in the forms of projections which overlap in the vertical direction, each projection defining approximately one-quarter of the cylinder for rotation between the bit extended and the bit retracted positions.

10 Claims, 6 Drawing Sheets

DRILL ASSEMBLY

BACKGROUND OF THE INVENTION

This invention relates to a drill assembly, and in particular to an eccentric earth boring drill assembly.

The drill assembly of the present invention was designed for drilling tough overburdens. The use of an eccentric assembly, i.e. an assembly having a bit eccentrically mounted at the bottom of a drill string results in the formation of a hole which is larger than the remainder of the drill string for facilitating insertion of a casing into a drilled hole. Drill tools with eccentric bits are disclosed, for example by U.S. Pat. Nos. 3,416,616, issued to H. H. Ahlgren on Dec. 17, 1968; 3,648,789, issued to A. S. Eriksson on Mar. 14, 1972; 3,753,470, issued to G. Lagerstrom et al on Aug. 21, 1973; 4,408,669, issued H. A. I. Wiredal on Oct. 11, 1983; 4,440,244, issued to H. A. I. Wiredal on Apr. 3, 1984 and 4,545,443 issued to H. A. I. Wiredal on Oct. 8, 1985.

A common problem with eccentric drill bits of the type described in the patent literature is that of removing the bit from the bottom end of the drill string following drilling. Another problem is that of replacing bits, which are commonly threaded into a mandrel or the like.

An object of the present invention is to provide solutions to the above defined problems in the form of a relatively simple drill assembly, which is easy and consequently relatively inexpensive to produce, and which facilitates penetration of a formation and aids casing insertion into a bore.

Another object of the invention is to provide a drill assembly including a bit of which can quickly and easily be connected to or removed from the remainder of the assembly.

BRIEF SUMMARY OF THE INVENTION

Accordingly, the present invention relates to a drill assembly comprising mandrel means for rotatable mounting in a casing shoe at the bottom end of a drill string; bit means for rotatable mounting in said mandrel means beneath the bottom end of the drill string, said bit means and mandrel means normally rotating together in one direction with said bit means eccentric with respect to said mandrel means, whereby the bit means can bore a hole larger in diameter than the casing shoe; head means on said bit means for engaging a formation to stop rotation of said bit means; shoulder means on said bit means and said mandrel means for retaining said bit means in the eccentric drilling position; and cam means on said bit means for engaging said casing shoe when the bit means is moved upwardly against the casing shoe to cause said bit means to rotate in the other direction to a release position in which said bit means is aligned with the casing shoe for movement therethrough.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT(S)

Figure 1:
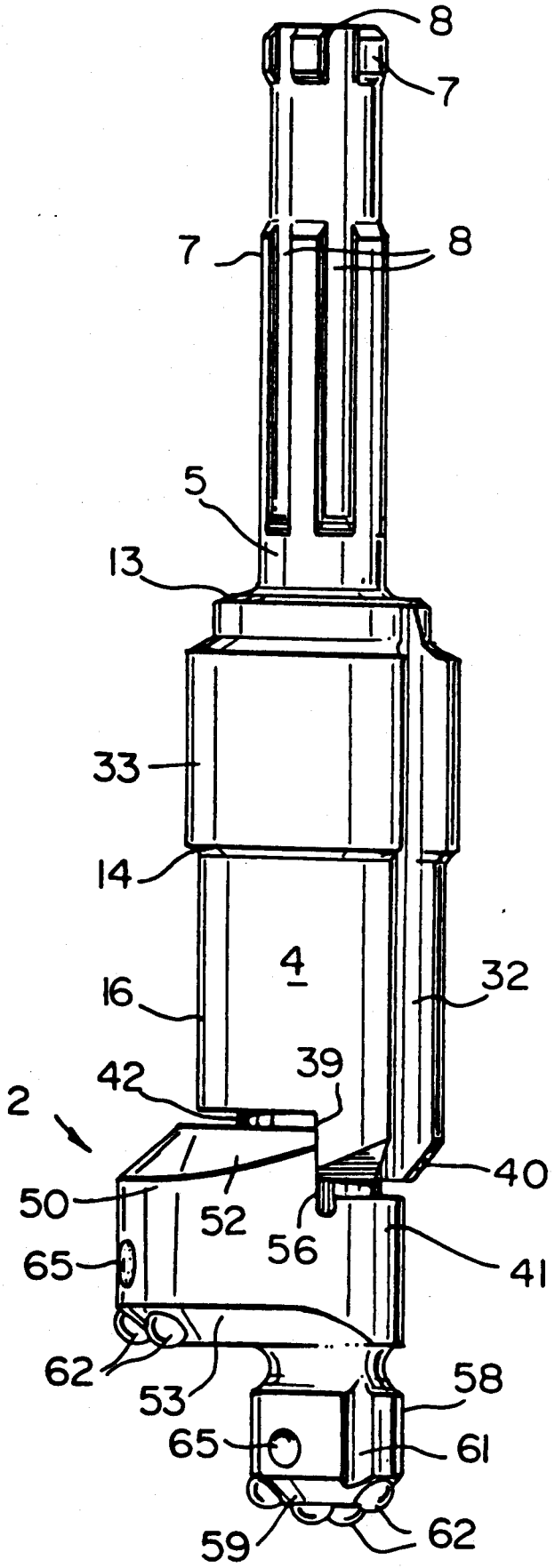
FIG. 1 is a side elevational view of a drill assembly in accord with the present invention.
Figure 2:
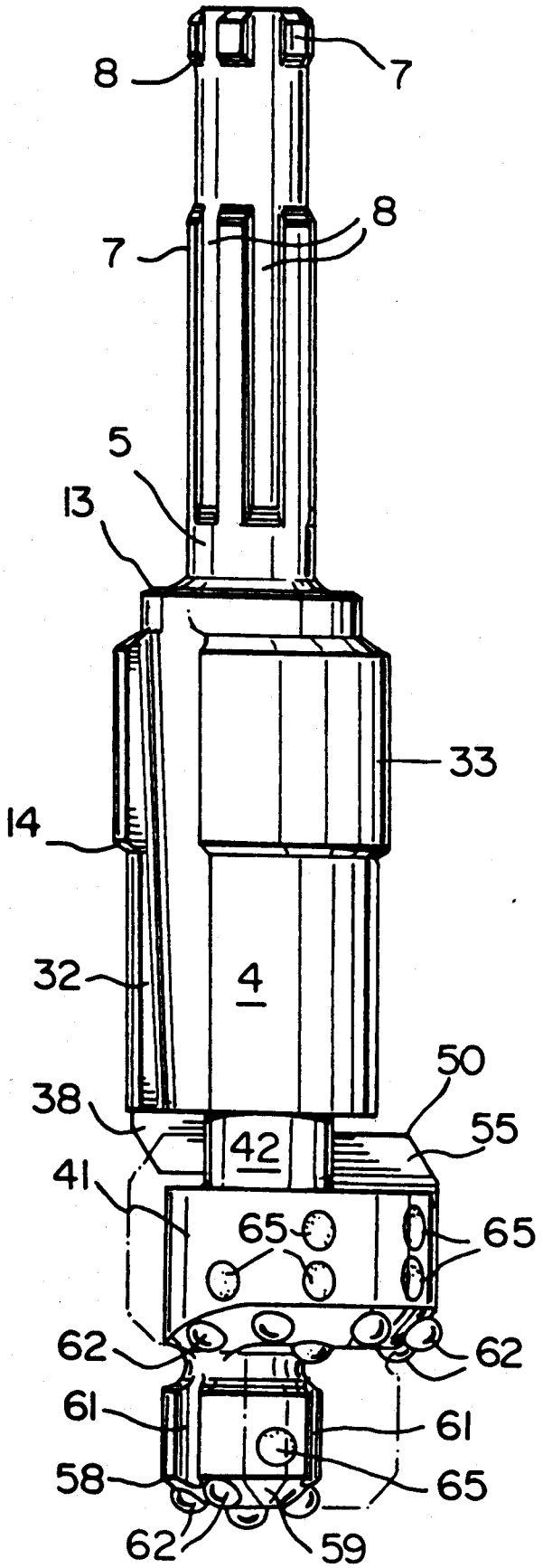
FIG. 2 is a side elevation view of the drill assembly of FIG. 1 as seen from the opposite side.
Figure 3:
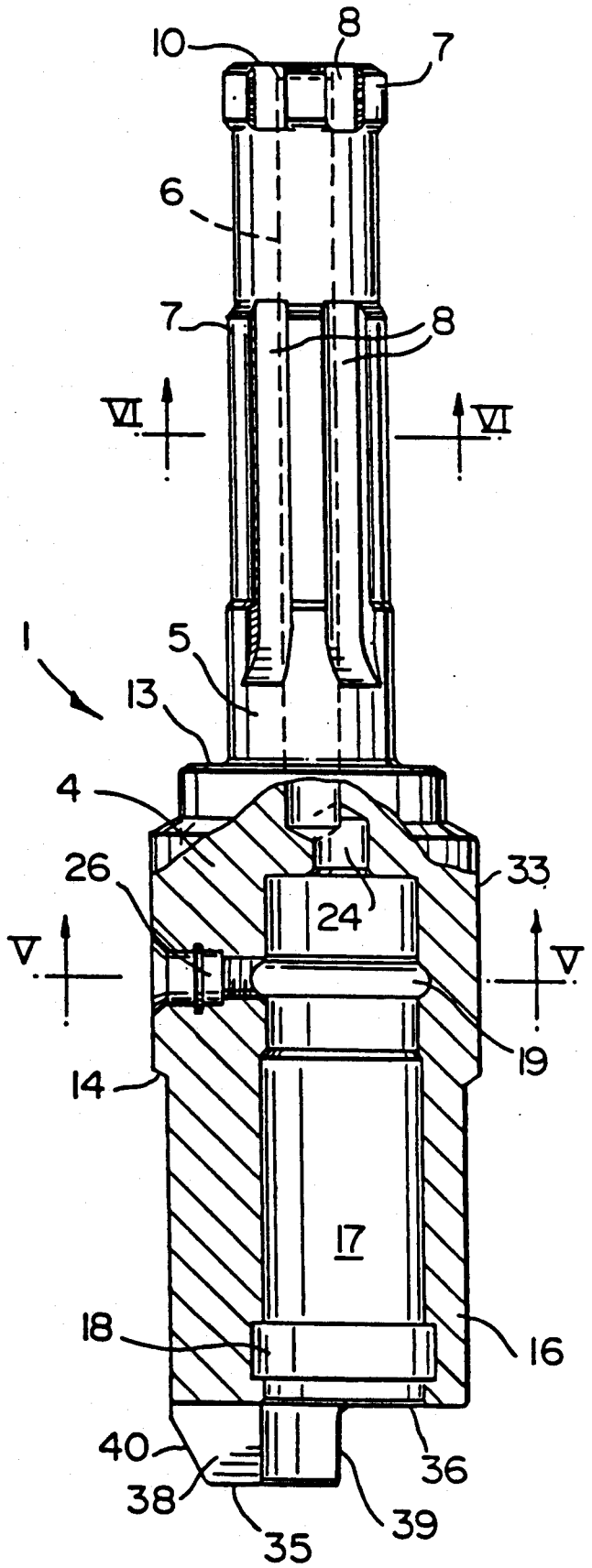
FIG. 3 is a partly longitudinally sectioned side elevation view of a mandrel used in the drill assembly of FIGS. 1 and 2.
Figure 6:
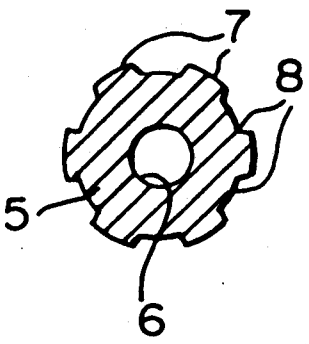
FIG. 6 is a cross section taken generally along line VI—VI of FIG. 3.
Figure 5:
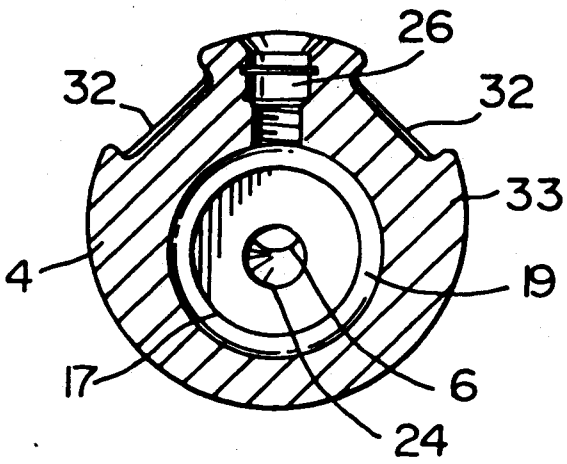
FIG. 5 is a cross section taken generally along line V—V of FIG. 3.
Figure 4:
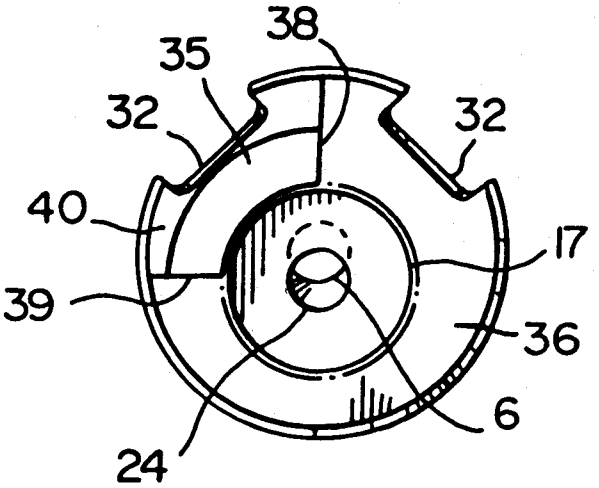
FIG. 4 is a bottom end view of the mandrel of FIG. 3.
Figure 8:
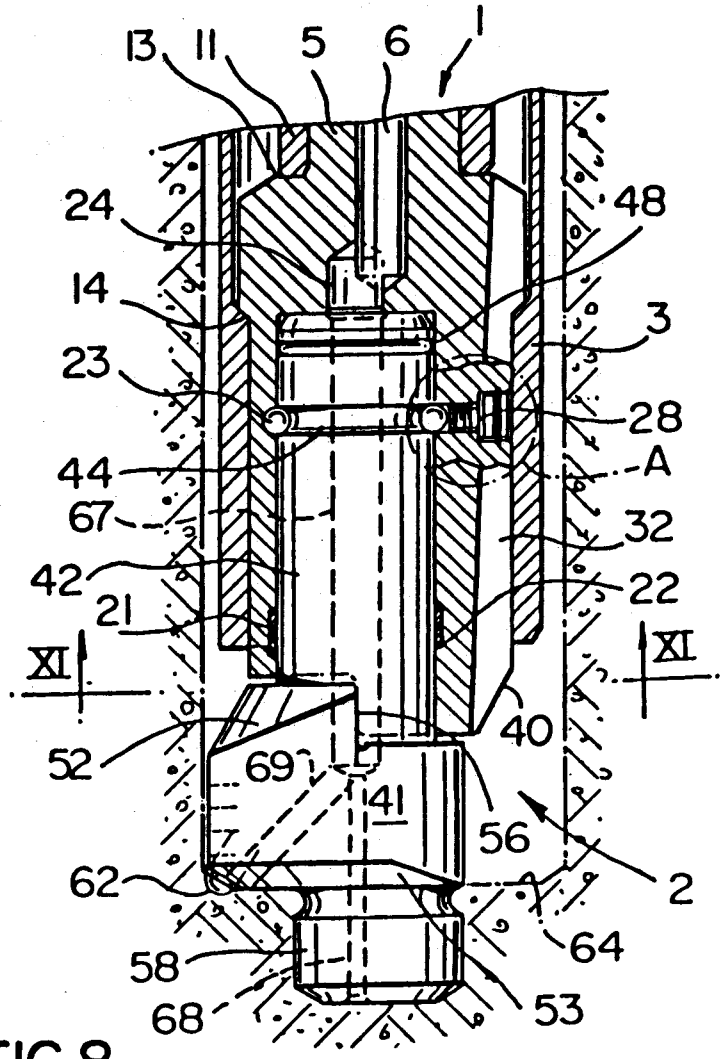
FIG. 8 is a longitudinal sectional view of the bottom end of a drill assembly of the type shown in FIGS. 1 and 2 in the position.

Referring to FIGS. 1 and 2, the main elements of the bit assembly of the present invention include a mandrel and a bit generally indicated at 1 and 2, respectively. The mandrel 1 and the bit 2 are mounted in the bottom end of a drill string (not shown), the lowermost element of which is cylindrical casing shoe 3 (FIG. 8).

As best shown in FIGS. 3 to 6, the mandrel 1 includes a solid, elongated body 4 with a narrow shank 5 at one end thereof. The shank 5 contains a central passage 6 therethrough for carrying air to the bit 2. Alternating, longitudinally extending ribs 7 and grooves 8 on the body and upper end 10 of the shank 5 facilitate connection of the latter to a vibrating hammer, the tubular bottom end 11 of which is shown in FIG. 8. The hammer engages a shoulder 13 at the bottom end of the shank 5. The shoulder 14 is case hardened to limit wear. A second shoulder 14 sloping in a direction opposite to the shoulder 13 limits downward movement of the mandrel 1 in the shoe 3. The mandrel 1 and bit 2 are used with a vibrating hammer, many types of which are commercially available. Therefore, the mandrel 1 will be adapted to the particular hammer with which it will be used.

The bottom end 16 of the mandrel 1 is tubular for receiving the bit 2. For such purpose, a longitudinally extending bore or passage 17 is provided in such bottom end 16. The bore 17 is eccentric, i.e. the longitudinal axis of the bore 17 is offset with respect to the longitudinal axis of the body 4 and the shank 5. Annular grooves 18 and 19 (FIG. 3) in the side of the bore 17 receive a wear ring 21, an O-ring 22 and balls 23 (FIG. 8) for retaining the bit 2 in the mandrel 1. A short passage 24 at the upper, closed end of the bore 17 communicates with the passage 6 for passing air to the bit 2. A threaded opening 26 in one side of the body communicates with the annular groove 19, so that the balls 23 can be placed in or removed from the groove 19. The countersunk outer end of the opening 26 is closed by a plug 28, a lock washer 29 and an annular clip 30. Longitudinally extending grooves 32 are provided in the exterior surface of the bottom end 16 and the larger diameter portion 33 of the body 4 between the shoulders 13 and 14 for discharging air and cuttings upwardly between the mandrel 1 and the shoe 3.

An arcuate projection 35 defining one quarter of a cylinder extends downwardly beyond the otherwise planer, annular bottom end 36 of the mandrel body 4. The sides of the projection 35 define longitudinally extending shoulders 38 and 39 for engaging the bit 2 in a manner described hereinafter in greater detail. The bottom edge 40 of the projection 35 is bevelled for promoting the flow of cuttings into the groove 32.

Figure 7:
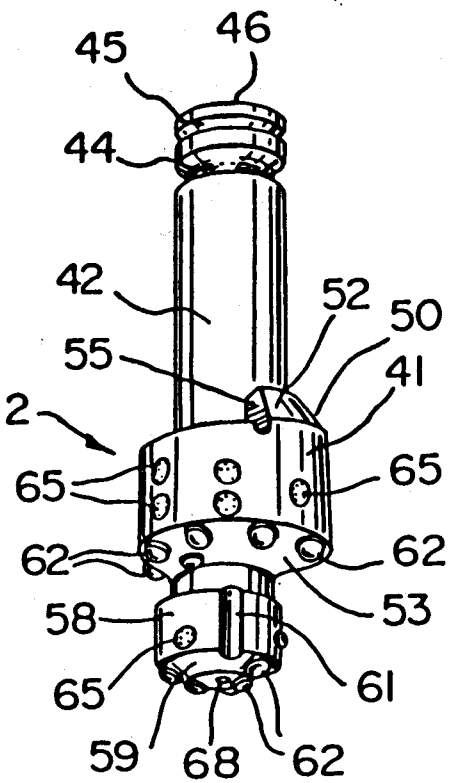
FIG. 7 is an isometric view of a bit used in the assembly of FIGS. 1 and 2.
Figure 11:
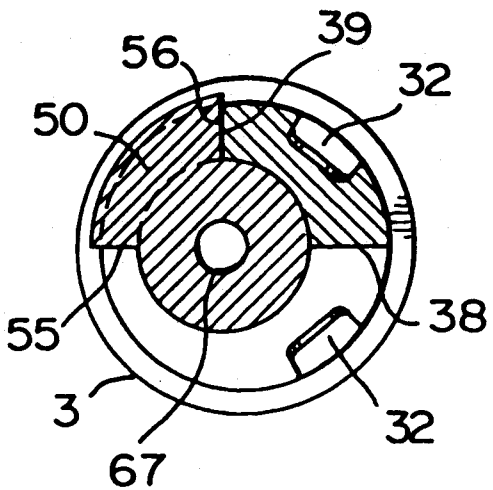
FIG. 11 is a cross section taken generally along line XI—XI of FIG. 8.
Figure 10:
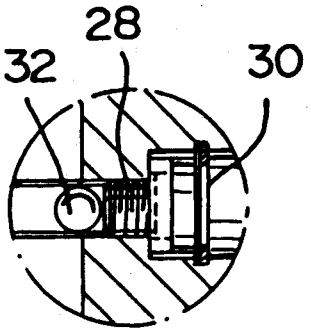
FIG. 10 is an enlarged view of the area in the circle A of FIG. 8.
Figure 9:
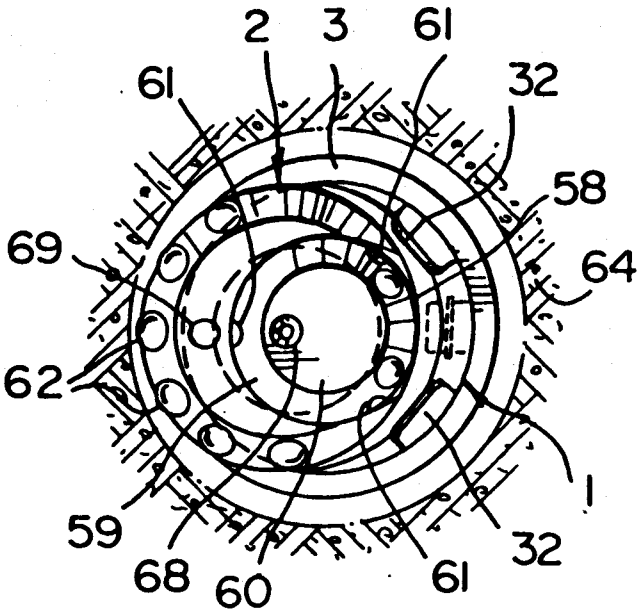
FIG. 9 is a bottom end view of the drill assembly of FIG. 8.

Referring to FIGS. 7 to 9, the bit 2 includes a cylindrically body 41 with a reduced diameter elongated cylindrical shank 42 at the top end thereof for mounting the bit 2 in the mandrel 1. Annular grooves 44 and 45 are provided in the upper end 46 of the shank 42 for receiving the balls 23 and an O-ring 48 (FIG. 8), respectively. The body 41 of the bit 2 is eccentric with respect to the shank 42, i.e., the longitudinal axis of the body 41 is offset with respect to the longitudinal axis of the shank 42. However, by rotating the shank 42 in the bore 17, the axis of the body 41 can be aligned with the longitudinal axis and the axis of rotation of the shank 5 of the mandrel 1. This action is taken when the bit is to be drawn up through the casing shoe 3.

For the above-mentioned purpose, a projection 50 defining one quarter of a cylinder is provided on the top end of the body 41 and the bottom end of the shank 42. The projection 50, which is integral with the body 41 and the shank 42, has a bevelled side edge 52 which tapers circumferentially. As described hereinafter in greater detail, the bevelled edge 52 acts as a cam during removal of the mandrel 1 and the bit 2 from the drill string. The bottom end 53 of the body is also bevelled. The ends of the projection 50 define a pair of shoulders 55 and 56.

A head 58 is provided on one side of the bottom end 53 of the body 41, i.e. the head 58 is eccentric with respect to the body 41. The head 58 has a smaller diameter than the body 41. The circular edge 59 of the bottom end 60 (FIG. 9) of the head 58 is bevelled. The slots 61 (FIGS. 1, 2, 7 and 9) are provided in the side of the head for promoting the flow of cuttings upwardly. Hemispherical tungsten carbide buttons 62 project out of the bottom ends 53 and 60 of the body 41 and the head 58, respectively. The buttons 62 are used to cut through a formation 64 (FIG. 8). Cylindrical gauge buttons 65 are provided in the sides of the body 41 and the head 58. The buttons 65 project a short distance out of the body 41 and the head 58 for preventing wear to the bit 2, and for ensuring the cutting of a uniform, cylindrical hole in the formation 64. An air passage 67 extends longitudinally through the centre of the shank 42 and the upper end of the head 58 of the bit 2 for receiving air under pressure from the passage 24. Smaller vertical and inclined passages 68 and 69, respectively discharge the air through the head 58 and the bottom 53 of the body 41.

During operation, with the bit shoulder 55 bearing against the shoulder 38 of the mandrel 1, the longitudinal axis of the body 41 is aligned with the longitudinal axis of the mandrel body 4. Thus the mandrel 1 and the bit 2 can be slid through the casing shoe 3. With the mandrel and bit 2 in position at the bottom of the casing shoe 3, when drilling is started, the head 58 engages the formation 64 which stops rotation of the bit 2. The mandrel 1 continues rotating until the shoulder 39 thereof engages the bit shoulder 56. Rotation of the bit 2 with respect to the mandrel 1 in this manner moves the axis of the body 41 out of alignment with the longitudinal axes of the shank 5 and the casing shoe 3, i.e. the body 41 becomes eccentric with respect to the mandrel 1 and the casing shoe 3.

When the mandrel 1 and the bit 2 are removed, they are pulled upwardly so that the bevelled cam edge 52 of the projection 50 contacts the bottom end of the shoe 3. Because of the bevel and taper of the edge 52, the bit 2 is caused to rotate in the direction opposite to the direction of rotation during drilling. The bit 2 rotates until the longitudinal axis of the bit body 41 is again aligned with the longitudinal axis of the mandrel 1, i.e. until the shoulders 38 and 55 of the mandrel 1 and the bit 2 are again abutting. The mandrel 1 and the bit 2 can then be moved as a unit upwardly through the casing shoe 3.

What is claimed is:

1. A drill assembly comprising mandrel means for rotatable mounting in a casing shoe at the bottom end of a drill string; bit means for rotatable mounting in said mandrel means beneath the bottom end of the drill string, said bit means and mandrel means normally rotating together in one direction with said bit means eccentric with respect to said mandrel means, whereby the bit means can bore a hole larger in diameter than the casing shoe; head means on said bit means for engaging a formation to stop rotation of said bit means; shoulder means on said bit means and said mandrel means for retaining said bit means in the eccentric drilling position; and cam means on said bit means for engaging said casing shoe when the bit means is moved upwardly against the casing shoe to cause said bit means to rotate in the other direction to a release position in which said bit means is aligned with the casing shoe for movement therethrough.

2. A drill assembly according to claim 1, wherein said shoulder means includes a first longitudinal shoulder on said mandrel means; and a second longitudinal shoulder on said bit means for engaging said first shoulder, said second shoulder means defining said cam means.

3. A drill assembly according to claim 2, including a first downwardly extending projection on said mandrel means defining said first shoulder; and a second upwardly extending projection on said bit means defining said second shoulder means.

4. A drill assembly according to claim 3, including a third shoulder on said first projection; and a fourth shoulder on said second projection for limiting rotation of said bit means beyond the release position.

5. A drill assembly according to claim 1, including an eccentric bore in the bottom end of said mandrel means for receiving said bit means; annular opposed groove means in said bore and in the upper end of said bit means; and ball means for removable mounting in said groove means to releasably retaining said bit means in said mandrel means.

6. A drill assembly according to claim 5, wherein said mandrel means includes first cylindrical body means; first shank means integral with first body means extending upwardly from the top end thereof, said body means containing said eccentric bore.

7. A drill assembly according to claim 6, wherein said bit means includes second cylindrical body mans; second shank means integral with said second body means extending upwardly from one side of the top of said second body means, said shank means containing one said annular groove means for receiving said ball means, said head means extending downwardly from one side of the bottom end of said second body means.

8. A drill assembly according to claim 7, wherein said mandrel means includes a first projection integral with said first body means extending downwardly from said first body means, said first projection defining a first shoulder.

9. A drill assembly according to claim 8, wherein said bit means includes a second projection integral with said second body means and said second shank means, said second projection extending upwardly along said second shank means and defining a second shoulder for engaging said first shoulder to cause said bit means to rotate with said mandrel means.

10. A drill assembly according to claim 9, including a third shoulder on said first projection; and a fourth shoulder on said second projection for engagement by said third shoulder to limit rotation of said bit means in said other direction to the release position.

* * * * *